US005224877A

United States Patent [19]

Yamamoto

[11] Patent Number: 5,224,877

[45] Date of Patent: Jul. 6, 1993

[54] SPACER MOUNTING STRUCTURE FOR CONNECTOR

[75] Inventor: Takayuki Yamamoto, Shizuoka, Japan

[73] Assignee: Yazaki Corporation, Japan

[21] Appl. No.: 857,634

[22] Filed: Mar. 25, 1992

[30] Foreign Application Priority Data

Mar. 28, 1991 [JP] Japan ..... 3-19411[U]

[51] Int. Cl.[5] ..... H01R 13/40

[52] U.S. Cl. ..... 439/595; 439/598; 439/751

[58] Field of Search ..... 439/347, 352, 374, 378, 439/595, 598, 603, 752

[56] References Cited

U.S. PATENT DOCUMENTS

| | | | |
|---|---|---|---|
| 4,343,523 | 8/1982 | Cairns et al. | 439/595 |
| 4,425,018 | 1/1984 | Stenz | 439/716 |
| 4,944,695 | 7/1990 | Tsuji et al. | 439/595 |
| 4,959,023 | 9/1990 | Watanabe et al. | 439/595 |
| 4,986,758 | 1/1991 | Wakata | 439/595 |
| 5,085,598 | 2/1992 | Kinoshita | 439/595 |
| 5,088,938 | 2/1992 | Murakami et al. | 439/595 |

FOREIGN PATENT DOCUMENTS

| | | |
|---|---|---|
| 92105298 | 9/1992 | European Pat. Off. . |
| 4114931 | 11/1991 | Fed. Rep. of Germany . |
| 62-1382 | 1/1987 | Japan . |

*Primary Examiner*—Paula A. Bradley

*Attorney, Agent, or Firm*—Wigman, Cohen, Leitner & Myers

[57] ABSTRACT

A spacer mounting structure for a connector comprises a housing and a spacer. The housing has a terminal accommodating chamber accommodating a male terminal element. The housing is provided with a flexible engaging arm within the terminal accommodating chamber, which is engaged with the male terminal element. The housing has an acceptant space which allows or permits the flexible engaging arm to be bent. The housing has a fitting hood section fitted with respect to a male connector. A first guide section extends from the fitting hood section to the acceptant space in an inserting direction. The spacer includes a spacer section inserted into the acceptant space, and a second guide section slidably engaged with the first guide section and extending in the inserting direction.

8 Claims, 4 Drawing Sheets

SPACER MOUNTING STRUCTURE FOR CONNECTOR

BACKGROUND OF THE INVENTION

The present invention relates to a spacer mounting structure for a connector, in which the spacer is mounted within an acceptant space for a flexible engaging arm being flexed or bent, which is formed within a terminal accommodating chamber for the connector having a fitting hood section.

FIG. 1 of the attached drawings shows a female connector 3 and a spacer 19 which is mounted on the female connector 3. In FIG. 1, the female connector 3 comprises a housing section 7 and a fitting hood section 9 which is formed integrally with the housing section 7.

The housing section 7 is formed with a pair of terminal accommodating chambers 5 and 5 each having both ends, one of which is open, within the fitting hood section 9. As shown in FIGS. 2A and 2B, a male terminal metallic part or element 11 is accommodated within each of the terminal accommodating chambers 5 and 5. The male terminal element 11 has, at a forward end thereof, an electric contact section 13 which projects into the fitting hood section 9. Further, the terminal accommodating chamber 5 is formed therein with a flexible engaging arm 15. An engaging section 15*a* is engaged with an engaging shoulder 11*a* of the male terminal element 11. Thus, removal of the male terminal element 11 from the terminal accommodating chamber 5 is prevented. Furthermore, the spacer 19 which is inserted through an opening 17*a* is mounted within an acceptant space 17 for the flexible engaging arm 15 being flexed or bent.

The spacer 19 is formed with a pair of recesses 19*a* and 19*a* for accepting the flexible engaging arms 15 and 15, respectively, as shown in FIG. 1.

In the case where the spacer 19 is mounted within the acceptant space 17, the spacer 19 can be held by two fingers and manually forced into the acceptant space 17 in the case of a female connector having the large fitting hood 9. In the case, however, of a connector in which the fitting hood 9 is small, that is, in the case where there are fewer terminal elements, it is impossible to force the spacer 19 into the acceptant space 17 by two fingers.

In view of the above, the spacer 19 is inserted into the fitting hood section 9 as shown in FIG. 2A under such a condition that the spacer 19 is clamped by a forward end of a jig 21 illustrated in FIG. 3. As shown in FIG. 2B, the spacer 19 is inserted into the acceptant space 17 through the opening 17*a* leading to in the acceptant space 17 on the side of the fitting hood section 9.

However, the exclusive jig 21 is required when the spacer 19 is inserted into the acceptant space 17. Many steps of mounting the spacer 19 on the jig 21 are required. Thus, mounting operability is deteriorated.

SUMMARY OF THE INVENTION

In view of the above, it is an object of the invention to provide a spacer mounting structure for a connector, which is capable of improving mounting operability of a spacer into an acceptant space.

According to the invention, there is provided a spacer mounting structure for a connector, comprising:

a housing having a terminal accommodating chamber accommodating a male terminal element, a flexible engaging arm engaged with the male terminal element in the terminal accommodating chamber, an acceptant space allowing the flexible engaging arm to be bent, a fitting hood section fitted to a male connector, and a first guide section extending from the fitting hood section to the acceptant space in an inserting direction; and a spacer having a spacer section inserted into the acceptant space, and a second guide section slidably engaged with the first guide section and extending in the inserting direction.

With the arrangement of the invention, the second guide section is inserted into the first guide section to move the spacer, whereby it is possible to mount the spacer within the acceptant space.

The spacer at this time is guided by the engagement between the first guide section and the second guide section. Accordingly, only pressing by a single finger enables the spacer to easily be mounted within the acceptant space. Accordingly, it is possible to improve operability of mounting of the spacer. Moreover, the exclusive jig is not required.

DETAILED DESCRIPTION OF THE PREFERRED EMBODIMENTS

A spacer mounting structure for a connector according to the invention will next be described with reference to an embodiment.

Figure 1:
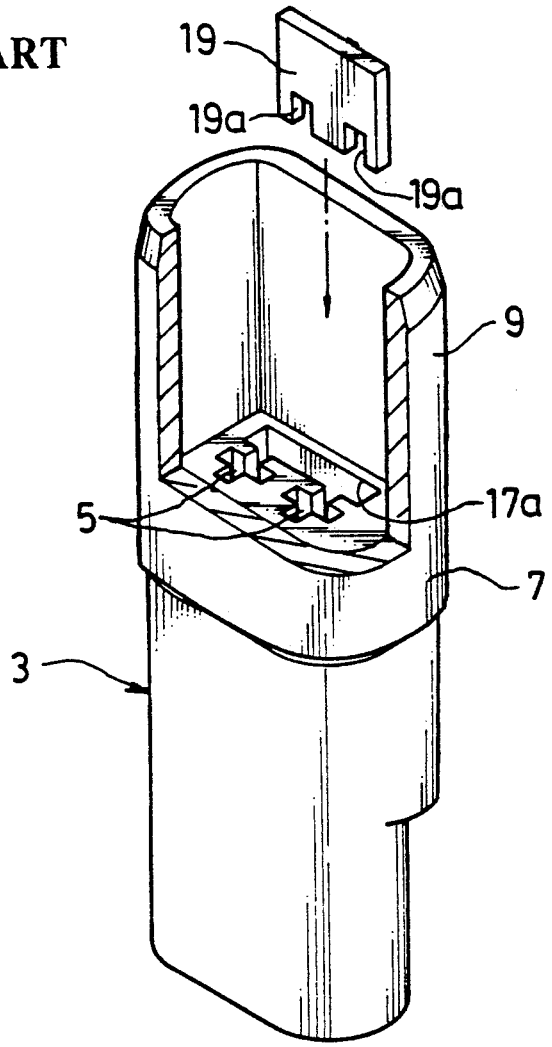
FIG.1 PRIOR ART
FIG. 1 is a perspective view showing conventional female connector and spacer.
Figure 3:
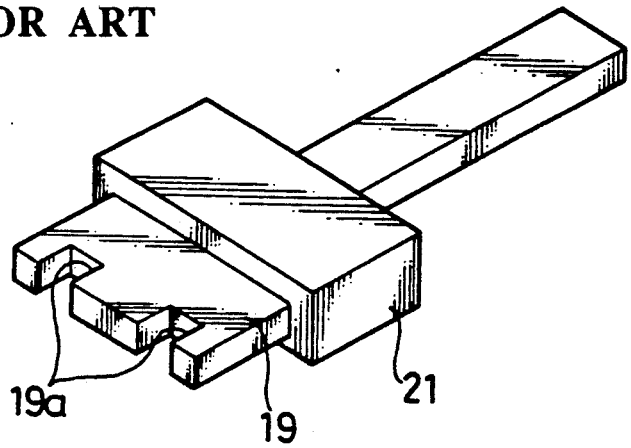
FIG.3 PRIOR ART
FIG. 3 is a perspective view showing a conventional jig for mounting the spacer into an acceptant space.
Figure 2A:
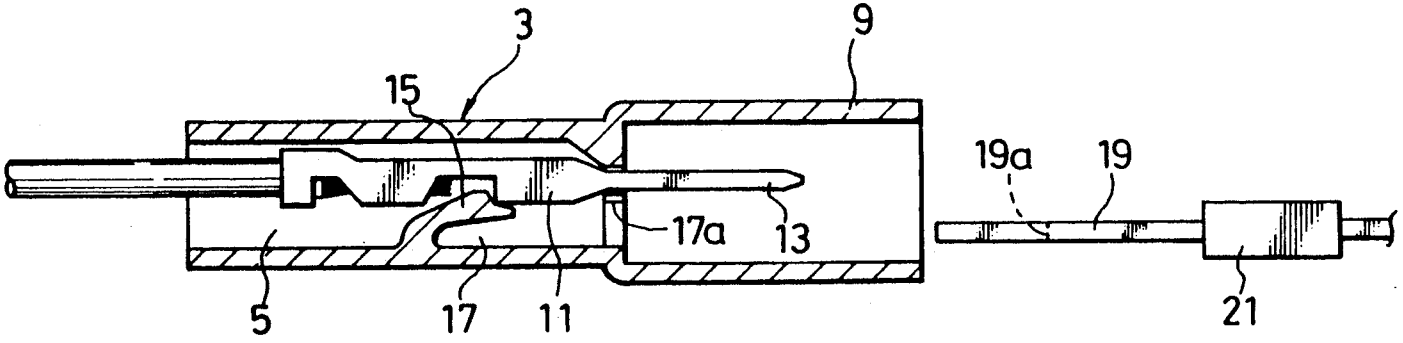
FIG.2A PRIOR ART
FIGS. 2A and 2B are cross-sectional views showing conventional procedure of mounting the spacer on the female connector.
Figure 2B:
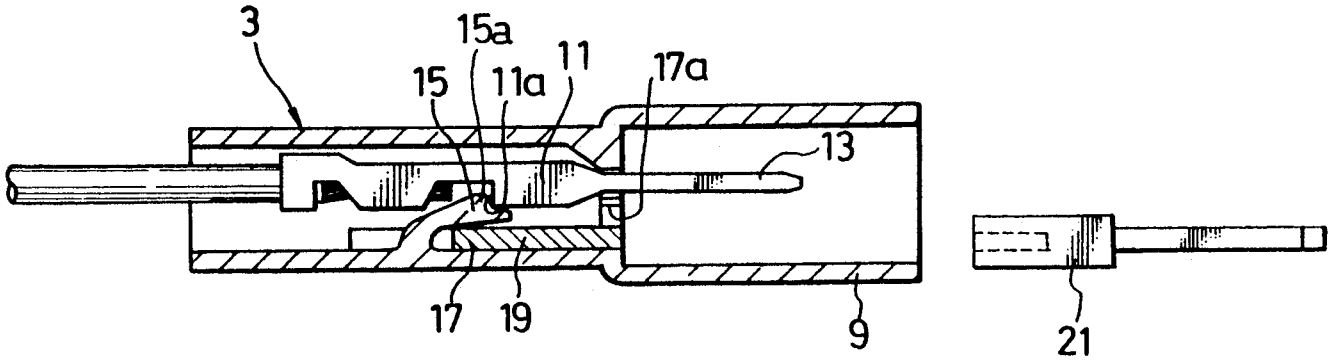
FIG.2B PRIOR ART
Figure 4:
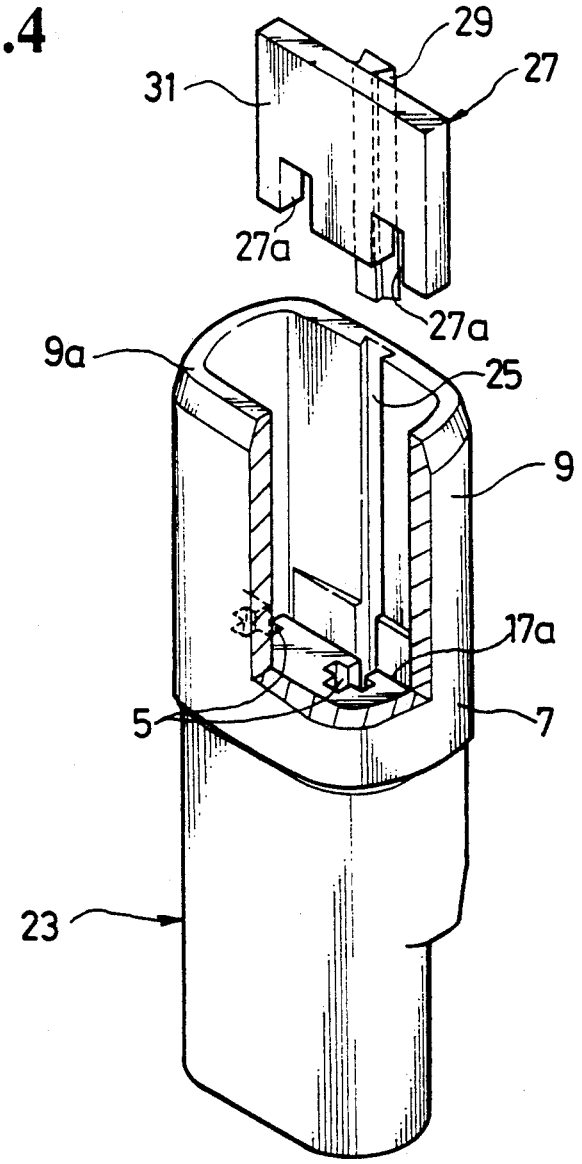
FIG. 4 is a perspective view showing a female connector and a spacer, according to the invention.

Referring first to FIG. 4, there is shown a female connector 23 and a spacer 27 mounted on the female connector 23. In FIG. 4, the female connector 23 comprises a housing section 7 and a fitting hood section 9 formed integrally with the housing section 7.

Figure 5:
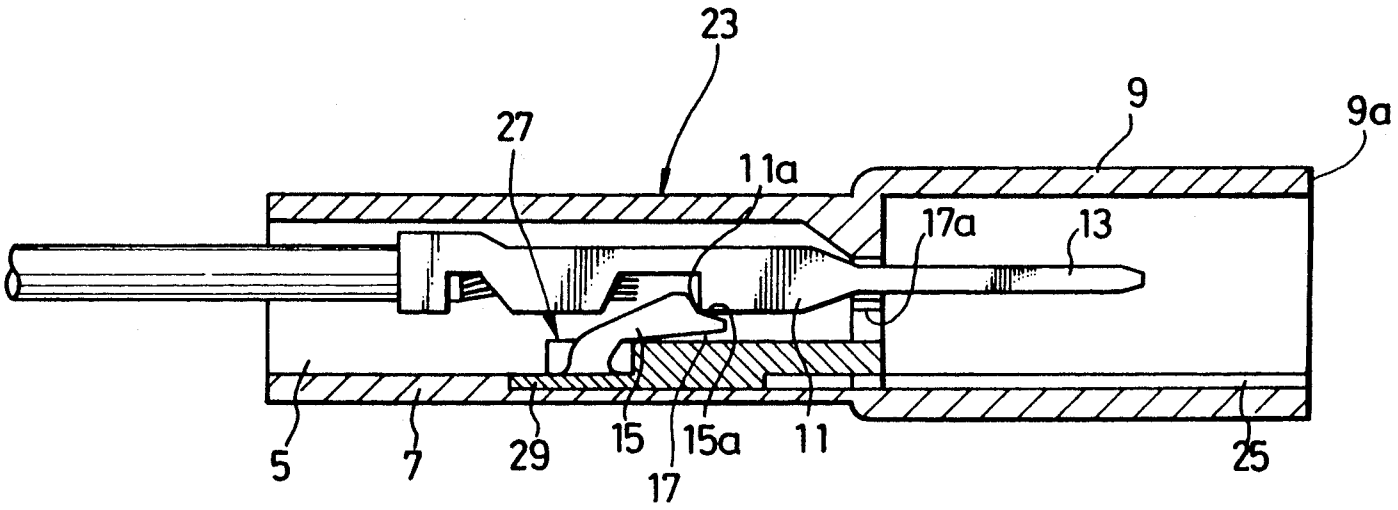
FIG. 5 is a cross-sectional view showing a relationship between the female connector and the spacer.

The housing section 7 is formed with a pair of terminal accommodating chambers 5 and 5 having respective open ends thereof within the fitting hood section 9. As shown in FIG. 5, a male terminal metallic part or element 11 is accommodated within each of the terminal accommodating chambers 5 and 5. The male terminal element 11 has, at its forward end, an electric contact section 13 which projects into the fitting hood section 9. Further, a pair of flexible engaging arms 15 and 15 are formed within the terminal accommodating chambers 5 and 5 respectively, and an engaging section 15*a* of the flexible engaging arm 15 is engaged with an engaging shoulder 11*a* of the male terminal element 11. Thus, removal of the male terminal element 11 from the terminal accommodating chamber 5 is prevented. Furthermore, a spacer 27 inserted through an opening 17*a* is mounted within an acceptant space 17 for the flexible engaging arm 15 being flexed or bent.

As shown in FIG. 4, the spacer 27 is formed with a pair of recesses 27*a* and 27*a* which accept the flexible engaging arms 15 and 15, respectively.

A guide groove 25 in the form of a dovetail groove, which is contiguous to the opening 17*a* in the acceptant space 17, is formed from an opening edge 9*a* of the fitting hood 9 of the female connector 23 and extends toward the housing section 7. The guide groove 25 extends in an inserting direction of the spacer 27. The guide groove 25 has a cross-sectional configuration which is formed into, for example, a trapezoid.

On the other hand, the spacer 27 comprises a guide rail section 29 fitted in the guide groove 25 for longitudinal movement, and a spacer section 31 inserted into the acceptant space 17. The guide rail section 29 has a forward end thereof which projects from the spacer section 31. The guide rail section 29 extends in an inserting direction of the spacer 27. The guide rail section 29 has a cross-sectional configuration which is formed into a configuration conforming to the guide groove 25, for example, into a trapezoid.

A mounting method of mounting the spacer 27 into the acceptant space 17 will next be described.

The guide rail section 29 is inserted into the guide groove 25 from the opening edge 9*a* of the fitting hood section 9, and an end of the spacer 19 is pressed or urged toward the housing section 7 by the force of a single finger against the spacer end. When the spacer 19 is urged toward the housing section 7, the spacer section 31 is inserted into the acceptant space 17. Further urging causes the spacer section 31 to be perfectly mounted within the acceptant space 17. Only urging of an end of the spacer 27 by a single finger at this time enables the spacer 27 to be mounted within the acceptant space 17. Thus, a mounting jig can be dispensed with.

Accordingly, according to the embodiment, it is possible to easily mount the spacer within the acceptant space so that mounting operability can be improved.

Moreover, since the mounting jig can be dispensed with, it is possible to curtail or cut down the cost for manufacturing the jig.

Further, since the guide groove 25 into which the guide rail section 29 is fitted is formed into the dovetail configuration, the guide rail 29 is prevented from coming off from the guide groove 25.

Figure 6:
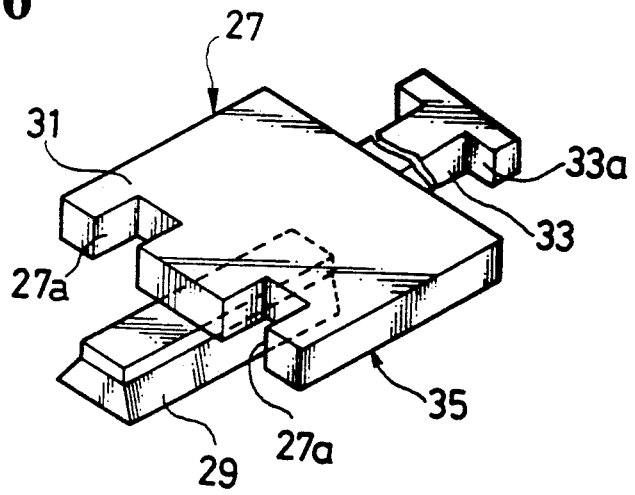
FIG. 6 is a perspective view showing another embodiment of the spacer.

Another embodiment will next be described with reference to FIG. 6. A spacer 35 according to the present embodiment is provided with an urging section 33 capable of being urged by a finger and contiguous to a spacer section 31. According to the present embodiment, since the urging section 33 can be urged by the finger, it is possible to further easily insert the spacer 35 into the acceptant space 17.

In connection with the above, a hook 33*a* is provided on the urging section 33, whereby the hook 33*a* can be utilized as a hooking section when the spacer 35 is pulled out or drawn out from the fitting hood section 9.

Furthermore, in the above-described embodiment, the guide groove 25 is formed as a groove in the form of a dovetail groove. However, the invention should not be limited to this. The guide groove may be one having another configuration.

Moreover, the above-described embodiment is arranged such that the guide groove 25 is formed in the female connector 23, and the guide rail section 29 is formed on the spacer 27 or 35. However, the arrangement should not be limited to this. The arrangement may be such that a guide groove is formed in the spacer 27 or 35, and the guide rail section 29 is formed on the female connector 23.

Further, the above-described embodiment is arranged such that the guide groove 25 is formed from the opening edge of the fitting hood section 9. However, the invention should not be limited to this. The arrangement may be such that the guide groove 25 is formed from a position other than the opening edge of the fitting hood section 9, if the position is a position where the guide rail section 29 can be fitted.

What is claimed is:

1. A spacer mounting structure for a connector, comprising:

a housing having a terminal accommodating chamber accommodating a male terminal element, a flexible engaging arm engaged with said male terminal element in the terminal accommodating chamber, an acceptant space allowing said flexible engaging arm to be bent, a fitting hood section fitted to a male connector, and a first guide section extending from said fitting hood section to said acceptant space in an inserting direction, said first guide section including a dovetail groove; and a spacer having a spacer section inserted into said acceptant space, and a second guide section slidably engaged with said first guide section and extending in the inserting direction, said second guide section including a guide rail adapted to be slidably engaged with said dovetail groove, the guide rail separated from the terminal accommodating chamber by the spacer section.

2. A spacer mounting structure for a connector according to claim 1, wherein said spacer further includes a pressing section capable of being pressed by a finger for inserting the spacer into said acceptant space, and a hook section to which the finger can be hooked for withdrawing the spacer from said acceptant space.

3. A spacer mounting structure for a connector according to claim 1, wherein said dovetail groove has a trapezoidal cross-section, and said guide rail has a trapezoidal cross-section conformable to said dovetail groove.

4. A spacer mounting structure for a terminal connector, comprising:

a housing having a terminal accommodating chamber for accommodating a terminal element, a flexible engaging arm engaged with the terminal element in the terminal accommodating chamber, a space to accommodate bending of the engaging arm, a fitting hood section fitted to the connector, and a first guide section extending from the fitting hood section to the bending space in an inserting direction, the first guide section including a groove; and a spacer having a spacer section inserted into the bending space, and a second guide section slidably engaged with the first guide section and extending in the inserting direction, the second guide section including a guide rail adapted to be slidably engaged with the groove, the guide rail being separated from the terminal accommodating chamber by the spacer section.

5. A spacer mounting structure for a connector according to claim 4, wherein the groove has a trapezoidal cross-section, and the guide rail has a trapezoidal cross-section conformable to said dovetail groove.

6. A spacer mounting structure for a connector according to claim 4, wherein the spacer includes means for inserting and withdrawing the spacer from the bending space.

7. A spacer mounting structure for a connector according to claim 6, wherein the means for inserting the spacer is a pressing section.

8. A spacer mounting structure for a connector according to claim 6, wherein the means for withdrawing the spacer is a hook section.

* * * * *